US007374375B2

(12) United States Patent
Kleine et al.

(10) Patent No.: US 7,374,375 B2
(45) Date of Patent: May 20, 2008

(54) SHANK FOR A ROTARY AND/OR PERCUSSION WORKING TOOL

(75) Inventors: Werner Kleine, Achim (DE); Werner Britten, Saarbruecken (DE)

(73) Assignee: Hilti Aktiengesellschaft, Schaan (LI)

( * ) Notice: Subject to any disclaimer, the term of this patent is extended or adjusted under 35 U.S.C. 154(b) by 410 days.

(21) Appl. No.: 11/139,751

(22) Filed: May 27, 2005

(65) Prior Publication Data

US 2005/0271487 A1 Dec. 8, 2005

(30) Foreign Application Priority Data

Jun. 2, 2004 (DE) ..... 10 2004 026 850

(51) Int. Cl.
*B25D 17/08* (2006.01)

(52) U.S. Cl. ..... 408/226; 175/320

(58) Field of Classification Search ..... 279/19.3–19.6; 408/226, 240; 175/320, 323, 394, 395
See application file for complete search history.

(56) References Cited

U.S. PATENT DOCUMENTS

| | | | |
|---|---|---|---|
| 4,047,722 A | 9/1977 | Nielsen | |
| 4,107,949 A | 8/1978 | Wanner et al. | |
| 4,655,651 A | 4/1987 | Hunger | |
| 5,028,057 A | 7/1991 | Wanner | |
| 6,174,112 B1 | 1/2001 | Kleine et al. | |
| 6,651,990 B2 * | 11/2003 | Higasi et al. | 279/19.4 |

FOREIGN PATENT DOCUMENTS

| | | | |
|---|---|---|---|
| DE | 2551125 A1 | | 5/1977 |
| DE | 3716915 A1 | | 12/1988 |
| DE | 3941646 A1 | * | 6/1991 |
| DE | 4307050 | | 9/1993 |
| DE | 4227949 A1 | * | 2/1994 |
| JP | 04-360703 A | | 12/1992 |

OTHER PUBLICATIONS

Search Report.

* cited by examiner

*Primary Examiner*—Daniel W. Howell
(74) *Attorney, Agent, or Firm*—Abelman, Frayne & Schwab

(57) ABSTRACT

A shank of a rotary-percussion working tool (2) has at least two, diametrically opposite locking grooves (5*a*, 5*b*) each having a locking shoulder (11) at an axial locking end (3) and spaced from a free end surface (4) of the shank (1), and an end shoulder (12) axially spaced from the locking shoulder (11) in a direction of a working tool-side end of the shank (1) and spaced from the axial locking end (3) of the shank (1) by a length (L) amounting at least to three times of a guide diameter (D) of the shank (1), and at least two entraining grooves (6*a*, 6*b*) mutually tangentially offset with respect to the locking grooves (5*a*, 5*b*), opening toward the free end surface (4), and having a tangential groove width (B) and at least one tangential, force application surface (7) extending over a contact length (K).

16 Claims, 2 Drawing Sheets

SHANK FOR A ROTARY AND/OR PERCUSSION WORKING TOOL

BACKGROUND OF THE INVENTION

1. Field of the invention

The present invention relates to a shank for a rotary and/or percussion working tool such as trepan, chisel, or boring bit for working stone, concrete, or brickwork.

2. Description of the Prior Art

Generally, a rotary and/or percussion working tool has a shank that extends along the working tool axis and is designed for a rotary and/or percussion hand-held power tool. For a random use of a multiple tool palette, the interface between a tool shank and a chuck of the power tool should be compatible at least within predetermined power classes. The presently used worldwide, in drill hammer systems, practically standardized shanks and associated chucks are disclosed, e.g., in German Publications DE 2551125A1 and DE 3716915A1. The disclosed shanks have a working too-side cylindrical guide surface, locking grooves which are axially closed at their ends adjacent to the free end surface of the shank, and trapezoidal entraining grooves which are open toward the free end surface of the shank. The associated chuck has at least one radially displaceable locking body that engages in a locking groove, limiting an axial displacement of the shank in the chuck.

The practically standardized shanks and chucks, which are disclosed in the German Publication DE 2551125A1, have a guide diameter of 10 mm, two identical, diametrically opposite, locking grooves, and two identical, diametrically opposite entraining grooves which are symmetrically distributed over the shank circumference. The entraining grooves, which are slightly longer than the locking grooves, are adjoined at their working tool side by a guide surface that extends up to the working tool-side end of the chuck and that does not contribute to the transmission of a torque. These shanks were initially designed for a drill diameter up to 17 mm and are, thus, associated with a range of small, not very powerful, hammer drills with a power smaller than 600 W. The more powerful hand-held power tools, in particular, hammer drills transmit, in predetermined operational modes, high torques to the working tool. Meanwhile, a practical operational field of the hammer drills expanded to a drill diameter of 30 mm. A particularly high torque is transmitted to the tool during its withdrawal from a work piece, in particular of a tool that became jammed in the bore. It has been shown that an increase of the drill diameter above 17 mm leads to damages, specifically, to breaking of the shank in the region of a locking groove and to destructions in the interior of the chuck. These damages are aggravated by the fact that the broken ends remain in the interior of the hammer drill and can be removed from the chuck only by dismounting the front portion of the hammer drill. Even in the case when during the use of drills having a larger diameter, a break does not take place, a plastic deformation of the shank takes place which leads to a non-uniform noticeable wear of the chuck. Because of this, working tools are often very difficult to withdraw from a chuck.

German Publications DE 3716195A1 discloses a practically standardized shank and chuck with a guide diameter 18 mm, with the shank having two, identical, diametrically opposite, locking grooves and arranged there between, three symmetrically distributed, entraining grooves one of which is arranged in one axial half of the shank and two of which are arranged in another shank half. This shank is designed for transmitting large torques in powerful, large hammer drills. Whit this shank, the problems, which were discussed in the preceding paragraph with reference to high power classes or torques are, naturally, likewise occur.

Drills with a guide diameter of 18 mm but with a smaller drill diameter of 14 mm have a poor blow transmission. Furthermore, such unproportional tools are not economically in manufacture.

The loads that act on such shanks includes the following components. On one hand, the shank is loaded by the blow energy of the hammer drill, On the other hand, a torsional load produced by the chuck rotary wedges, which is determined by a torque acting on the bit, is transmitted to the entraining grooves. The torque is particularly high when, e.g., the bit is wedged during drilling in reinforced concrete. An additional load is applied in case of wedging in a reinforcing metal, e.g., during an attempt to pull the drill back. In addition, a load, which is applied by the locking body at the axial locking end of the locking groove, acts on the rear cross-section of the locking groove. A multi-year experience has shown that these multiple loads endanger, in particular, the cross-section of the shank in the region of the axial locking end of the shank. The mechanical fracturing causes of this are suspected to lie in local, pronounced, multi-axis stress state which produces a local stiffening that is caused by a transverse contraction. The stiffening represents a primary fracture initiator, limiting the fatigue strength of the shank which is subjected to alternating stresses.

U.S. Pat. No. 4,655,651 disclosed a shank having a working tool-side cylindrical guide surface, three axial pointed grooves opening toward the free end and surface of the shank, and a plurality of axial locking grooves offset relative to the pointed grooves and having each a locking shoulder remote from the shank free end surface, with the locking grooves being at least, partially super-imposed on the pointed grooves. The three pointed grooves, each of which has an angle of 120° between the legs, serve for receiving the clamping jaws of a three-jaw chuck. Such tapering, inclined to a radius by 60°, legs are not suitable for transmissions of high torques that occur, in particular, in tool blocks. In addition, the locking grooves, reduce the leg surface available for transmission of a torque.

Accordingly, an object of the present invention is a shank capable of both transmitting high torques without being damaged, and providing an optimal blow pulse transmission.

SUMMARY OF THE INVENTION

This and other objects of the present invention, which will become apparent hereinafter, are achieved by providing a shank of a working tool that rotates about an axis and/or is blow-driven along the axis, with the shank extending along the axis and having a maximal guide diameter and including at least two, arranged opposite each other, locking grooves each having a locking shoulder provided at an axial locking end and spaced from a free end surface of the shank, and an end shoulder axially spaced from the locking shoulder in a direction of a working tool—side end of the shank by a length amounting at least to three times of the guide diameter. The shank further has two entraining grooves mutually tangentially offset with respect to the locking grooves, opening toward the free end surface, having a tangential groove width, and at least one tangential, force application surface extending over a contact length.

As a result of the provision of an end shoulder, which is spaced, in the direction toward the working tool-side end of the shank, from the locking shoulder as far as possible, the change in the cross-section of the locking groove first takes place in the vicinity of the working tool-side end of the shank. Thereby, at least in tool with a stem diameter smaller than or equal to the guide diameter, a reflection region having a length of minimum e-time of the guide diameter, where e is the base of a natural logarithm, which reflection region changes the acoustic impedance and, thus, upsets the tansmission of the blow pulse, is avoided. In particular, high torques can be transmitted without causing any damage at smaller guide diameters, which improves blow pulse behavior at small drill diameters.

Advantageously, the end shoulder of the locking groove is axially spaced from a working tool-side of a respective entraining groove in the direction of the working tool-side end of the shank at least by 1.5 times of the guide diameter.

Thereby, the cross-sectional change is axially spaced from the working tool-side ends of the tangentially stressed entraining grooves sufficiently far to avoid a multi-axial stress condition at the working tool-side end of the load application region.

Advantageously, an axial guide length between a working tool-side guide end with the guide diameter and the end shoulder of both locking grooves is smaller than 1.5 times of the guide diameter. Thereby, a sufficiently long guide length up to the working tool-side end is realized, with a good blow pulse transmission behavior.

Advantageously, the tangential force application surface extends, at least over the contact length, both parallel to and transverse to the working tool axis. Thereby, the surface normal of the tangential force application surface is oriented exactly tangentially. Therefore, upon application of a torque, no shear forces, which cause an excess wear, are induced.

Advantageously, at least over the contact length, a radial groove depth of each entraining groove amounts to between 0.5 and 1 times of the groove with. Thereby, high torques can be transmitted without a noticeable weakening of the cross-section and with a sufficient web that engages in the entraining groove.

Advantageously, there are provided at least three entraining grooves which are, advantageously are arranged mirror symmetrically. This insures transmission of high torques.

Advantageously, the end shoulder of each of the locking grooves is formed by the working tool-side end shoulder of a respective further locking groove which is axially spaced, in the direction toward the working tool-side end of the shank, from the respective locking groove and is separated therefrom. Thereby, there are provided intermediate shoulders that further limit the axial displacement of the working tool in the chuck.

Advantageously, the locking grooves and the further locking grooves of the chuck have the same cross-section. Thereby, locking bodies, of the chuck, which have the same cross-section, can be used for both grooves.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1A:
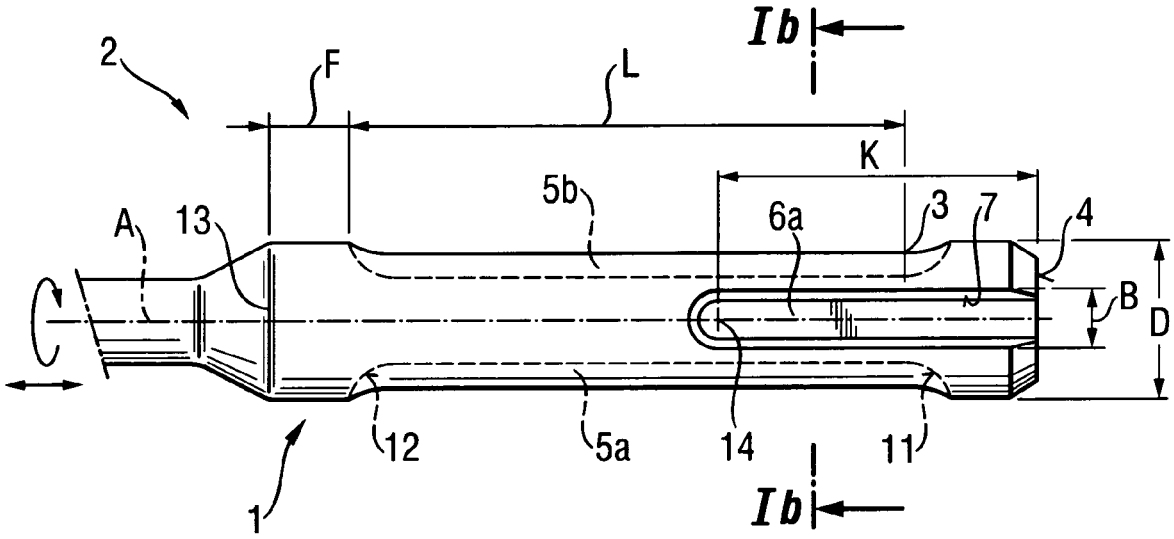
FIG. 1*a* a side view of a shank according to the present invention.
Figure 1B:
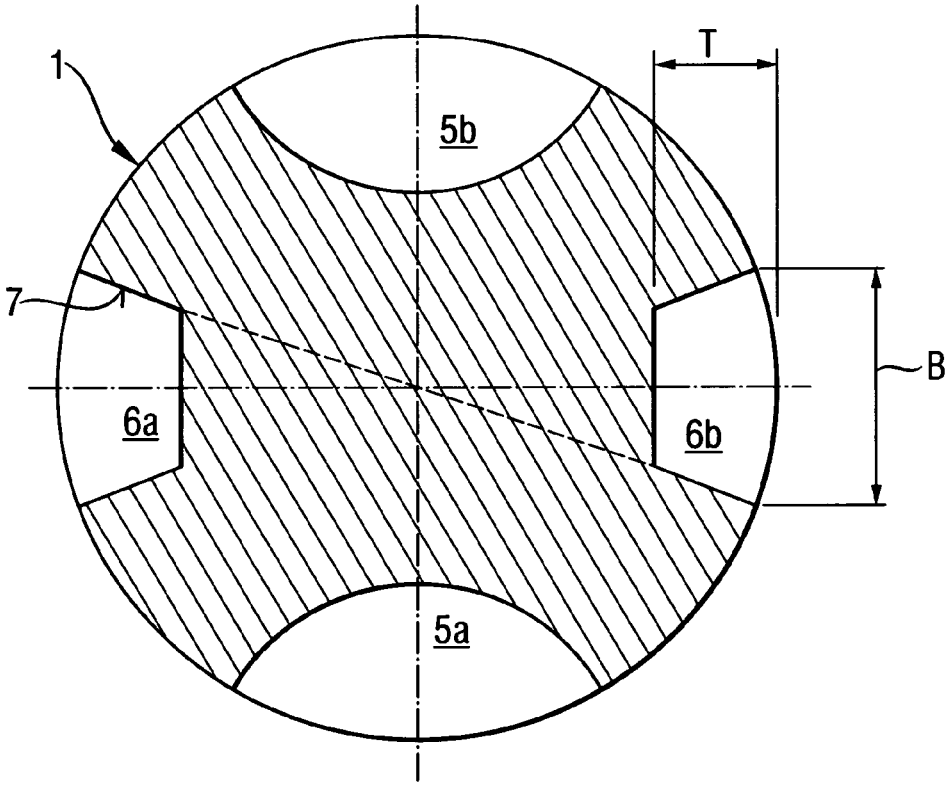
FIG. 1*b* a cross-sectional view along line Ib-Ib in FIG. 1*a* at an increased, in comparison with FIG. 1*a*, scale.

FIGS. 1*a*-1*b* show a shank 1 according to the present invention of a rotary-percussion working tool 2 rotatable about and displaceable along an axis A. The shank 1 has a twofold rotational symmetry and extends along the axis A, with a maximal guide diameter D. The shank 1 has two identical, arranged diametrically opposite each other, locking grooves 5*a*, 5*b*. The locking grooves 5*a*, 5*b* are provided at an axial locking end 3 with a locking shoulder 11, respectively, remote from a free end surface 4 of the shank 1. The shank 1 further has two entraining grooves 6*a*, 6*b* mutually tangentially offset with respect to the locking grooves 5*a*, 5*b* and having a tangential groove width B. The entraining grooves 6*a*, 6*b* have each a tangential force application surface 7 extending along a contact length K parallel to and transverse to the axis A. Each of the locking grooves 5*a*, 5*b* has, at its working tool side, an end shoulder 12 axially spaced from the respective locking shoulder 11. The end shoulder 12 is spaced from the axial locking end 3 by a distance L that amounts to 3.5 times of the guide diameter D. For each of the locking grooves 5*a*, 5*b*, there is provided an axial guide length F measured between the working tool-side end 13 and the end shoulder 12. The axial guide length F is equal to a half of the guide diameter D. The end shoulder 12 is axially spaced from the working tool-side end 15 of the entraining groove 6*a*, 6*b* by more than double of the guide diameter D. Both entraining grooves 6*a*, 6*b* have, over the contact length K which is equal to double of the guide diameter D, a constant groove width B that amounts to approximately a third of the guide diameter D. A radial groove depth T of both entraining grooves 5*a*, 5*b* amounts to a half of the groove width B over the entire contact length K.

Figure 2A:
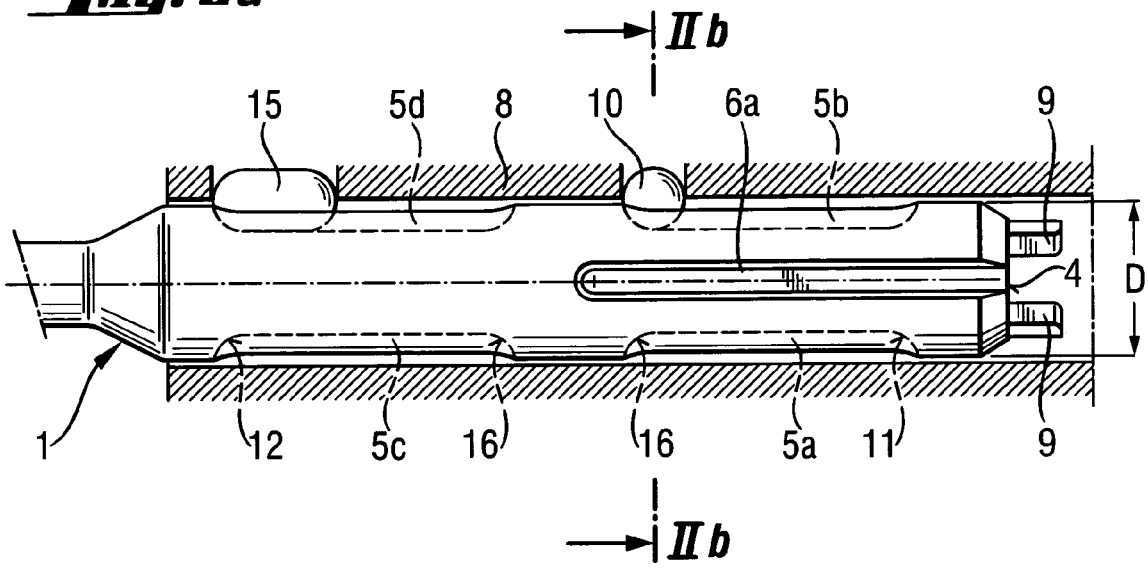
FIG. 2*a* a side view of another embodiment of a shank according to the present invention.
Figure 2B:
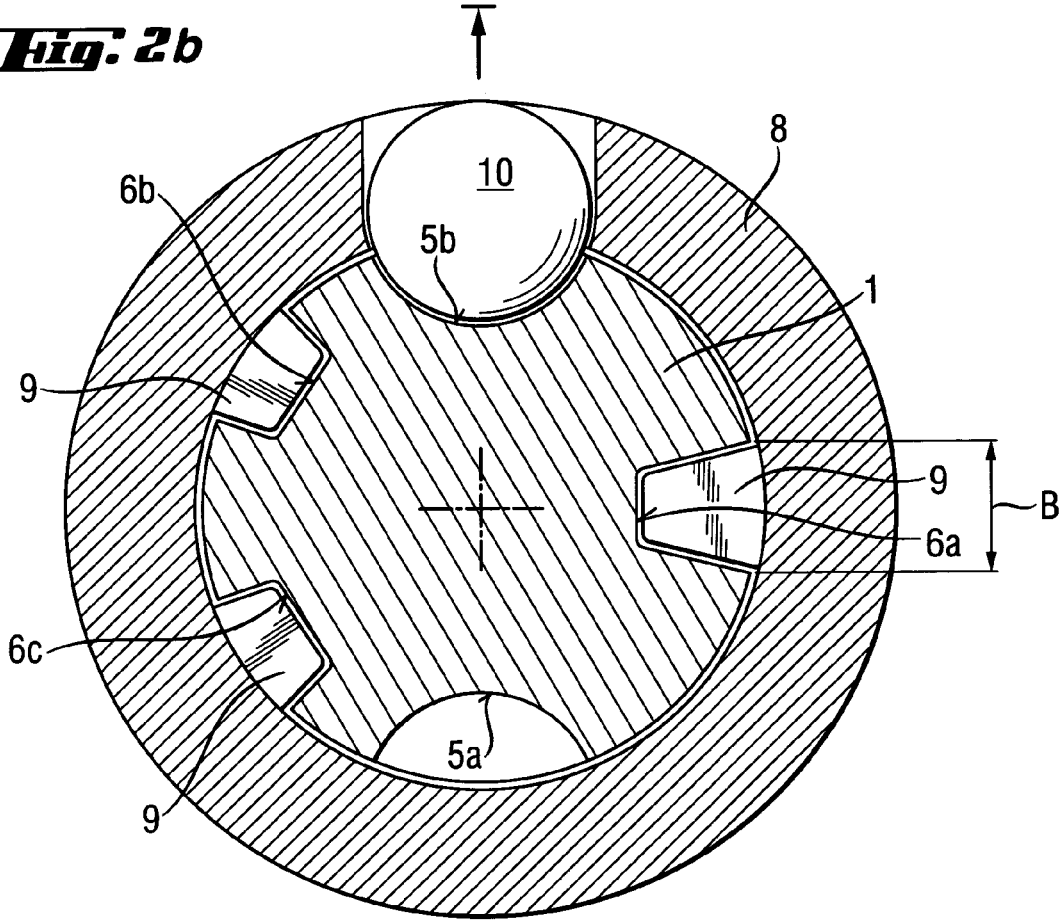
FIG. 2*b* a cross-sectional view along line IIb-IIb in FIG. 2*a* at an increased, in comparison with FIG. 2*a*, scale.

FIGS. 2*a*-2*b* show a mirror-symmetrical shank 1 and a chuck 8 for receiving a percussion tool and having entraining means 9 in form of three, projecting radially inwardly, entraining webs extending toward the working tool-end of the chuck, and two radially offset locking elements in form of a locking ball 10 and an axially extending roller 15. The shank 1 has three entraining grooves 6*a*, 6*b*, 6*c* having a constant groove width B that amounts to one-fifth of the guide diameter D, and opening toward the free end surface 4. The three, arranged mirror-symmetrically, entraining grooves 6*a*, 6*b*, 6*c* are circumferentially symmetrically offset from two diametrically opposite, locking grooves 5*a*, 5*b*. The end shoulders 12, which are axially spaced from the locking shoulders 11, respectively, are formed by further locking grooves 5*c*, 5*d* which are axially spaced from the locking grooves 5*a*, 5*b* and are separated therefrom. The grooves 5*c*, 5*d* have the same cross-section as grooves 5*a*, 5*b*. At adjacent ends of the locking grooves 5*a*, 5*b* and 5*c*, 5*d*, intermediate shoulders 16 are formed.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A shank of a working tool (2) that at least one of rotates about an axis (A) and is blow-driven at least partially along the axis (A), the shank (1) extending along the axis (A) with a maximal guide diameter (D) and comprising at least two, arranged opposite each other, locking grooves (5*a*, 5*b*) each having a locking shoulder (11) provided at an axial locking end (3) and spaced from a free end surface (4) of the shank (1), and an end shoulder (12) axially spaced from the locking shoulder (11) in a direction of a working tool-side end of the shank (1) and spaced from the axial locking end (3) of at least one of the locking grooves (5*a*, 5*b*) by a length (L) amounting at least to three times of the guide diameter (D); and at least two entraining grooves (6*a*, 6*b*) mutually tangentially offset with respect to the locking grooves (5*a*, 5*b*) and opening toward the free end surface (4), the at least two entraining grooves (6*a*, 6*b*) having a tangential groove width (B) and at least one tangential, force application surface (7) extending over a contact length (K);

wherein the end shoulder (12) is axially spaced from a working tool-side end (14) of a respective entraining groove (6*a*, 6*b*) in the direction of the working tool-side end of the shank (1) at least by 1.5 times of the guide diameter (D).

2. A shank of a working tool (2) that at least one of rotates about an axis (A) and is blow-driven at least partially along the axis (A), the shank (1) extending along the axis (A) with a maximal guide diameter (D) and comprising at least two, arranged opposite each other, locking grooves (5*a*, 5*b*) each having a locking shoulder (11) provided at an axial locking end (3) and spaced from a free end surface (4) of the shank (1), and an end shoulder (12) axially spaced from the locking shoulder (11) in a direction of a working tool-side end of the shank (1) and spaced from the axial locking end (3) of at least one of the locking grooves (5*a*, 5*b*) by a length (L) amounting at least to three times of the guide diameter (D); and at least two entraining grooves (6*a*, 6*b*) mutually tangentially offset with respect to the locking grooves (5*a*, 5*b*) and opening toward the free end surface (4), the at least two entraining grooves (6*a*, 6*b*) having a tangential groove width (B) and at least one tangential, force application surface (7) extending over a contact length (K);

wherein an axial guide length (F) between a working tool-side guide end (13) with the guide diameter (D) and the end shoulder (12) of both locking grooves (5*a*, 5*b*) is smaller than 1.5 times of the guide diameter (D).

3. A shank according to claim 1, wherein the tangential, force application surface (7) extends, at least over the contact length (K), in at least one direction which includes components which are parallel to and perpendicular to the axis (A).

4. A shank according to claim 1, wherein at least over the contact length (K), a radial groove depth (T) of each entraining groove (6*a*, 6*b*) amounts to between 0.5 and 1.0 times of a groove width (B).

5. A shank according to claim 1, comprising at least three entraining grooves (6*a*, 6*b*, 6*c*).

6. A shank according to claim 5, wherein the at least three entraining grooves (6*a*, 6*b*, 6*c*) are arranged mirror-symmetrically.

7. A shank of a working tool (2) that at least one of rotates about an axis (A) and is blow-driven at least partially along the axis (A), the shank (1) extending along the axis (A) with a maximal guide diameter (D) and comprising at least two, arranged opposite each other, locking grooves (5*a*, 5*b*) each having a locking shoulder (11) provided at an axial locking end (3) and spaced from a free end surface (4) of the shank (1), and an end shoulder (12) axially spaced from the locking shoulder (11) in a direction of a working tool-side end of the shank (1) and spaced from the axial locking end (3) of at least one of the locking grooves (5*a*, 5*b*) by a length (L) amounting at least to three times of the guide diameter (D); and at least two entraining grooves (6*a*, 6*b*) mutually tangentially offset with respect to the locking grooves (5*a*, 5*b*) and opening toward the free end surface (4), the at least two entraining grooves (6*a*, 6*b*) having a tangential groove width (B) and at least one tangential, force application surface (7) extending over a contact length (K);

wherein the end shoulder (12) of each of the locking grooves (5*a*, 5*b*) is formed by the working tool-side end shoulder of a respective further locking groove (5*c*, 5*d*) axially spaced, in the direction toward the working tool-side end of the shank (1), from the respective locking groove (5*a*, 5*b*) and separated therefrom.

8. A shank according to claim 7, wherein the locking grooves (5*a*, 5*b*) and the further locking grooves (5*c*, 5*d*) have a same cross-section.

9. A shank according to claim 2, wherein the tangential, force application surface (7) extends, at least over the contact length (K), in at least one direction which includes components which are parallel to and perpendicular to the axis (A).

10. A shank according to claim 2, wherein at least over the contact length (K), a radial groove depth (T) of each entraining groove (6*a*, 6*b*) amounts to between 0.5 and 1.0 times of a groove width (B).

11. A shank according to claim 2, comprising at least three entraining grooves (6*a*, 6*b*, 6*c*).

12. A shank according to claim 11, wherein the at least three entraining grooves (6*a*, 6*b*, 6*c*) are arranged mirror-symmetrically.

13. A shank according to claim 7, wherein the tangential, force application surface (7) extends, at least over the contact length (K), in at least one direction which includes components which are parallel to and perpendicular to the axis (A).

14. A shank according to claim 7, wherein at least over the contact length (K), a radial groove depth (T) of each entraining groove (6*a*, 6*b*) amounts to between 0.5 and 1.0 times of a groove width (B).

15. A shank according to claim 7, comprising at least three entraining grooves (6*a*, 6*b*, 6*c*).

16. A shank according to claim 15, wherein the at least three entraining grooves (6*a*, 6*b*, 6*c*) are arranged mirror-symmetrically.

* * * * *